United States Patent [19]

Lee

[11] Patent Number: 4,802,615

[45] Date of Patent: Feb. 7, 1989

[54] TAG ATTACHING APPARATUS

[76] Inventor: Duck H. Lee, 804-14, Bangbae-Dong, Kangnam-Ku, Seoul, Rep. of Korea

[21] Appl. No.: 120,143

[22] Filed: Nov. 13, 1987

[51] Int. Cl.[4] ..... A41H 37/00; B25C 1/00; B65C 5/06; A43D 69/00

[52] U.S. Cl. ..... 227/67

[58] Field of Search ..... 227/67, 95

[56] References Cited

U.S. PATENT DOCUMENTS 3,924,788 12/1975 Furutu ..... 227/67
4,448,194 5/1984 DiGiovanni et al. ..... 277/67 X
4,482,088 11/1984 Hyun ..... 227/67
4,592,499 6/1986 Kato ..... 227/67
4,593,844 6/1986 Bone ..... 227/67

*Primary Examiner*—Paul A. Bell
*Attorney, Agent, or Firm*—Birch, Stewart, Kolasch & Birch

[57] ABSTRACT

A tag attaching apparatus includes a pawl member including a sliding member connected to a fastener rod for attaching a tag to the garments and a connecting rod connected to a fastener feed wheel through a convertible lever for rotating the fastener feed wheel in the counterclockwise direction when the sliding member moves backward.

2 Claims, 3 Drawing Sheets

TAG ATTACHING APPARATUS

BACKGROUND OF THE INVENTION

1. Field of the Invention

The present invention relates to a tag attaching apparatus and more particularly, to an improved tag attaching apparatus which includes a pawl member operatively connected to a sliding member and a fastener feed wheel connected to the pawl member through connecting means whereby the tag attaching apparatus is readily and easily operated.

2. Detailed Description of Prior Art

In many of the tag attaching apparatus known in the art, the mechanisms are very complicated rendering them unacceptable for commercial applicability or availability. Such tag attaching apparatus are shown in U.S. Pat. Nos. 3,103,666 to Bone, dated Sept. 17, 1963, 3,470,834 to Bone, dated Oct. 7, 1963, 3,650,452 to Finke, dated Mar. 21, 1972, 3,924,788 to Furutu, dated Dec. 9, 1975, 3,971,498 to Bussard, dated July 27, 1976, 4,040,555 to Jenkins, dated Aug. 9, 1977, 4,049,177 to Bussard, dated Sept. 20, 1977, and 4,049,179 to Jenkins, dated Sept. 20, 1977.

SUMMARY OF THE INVENTION

Accordingly, it is an object of the present invention to provide an improved tag attaching apparatus which is simple in construction and relatively inexpensive to manufacture.

Another object of the present invention is to provide a tag attaching apparatus which is structured with a pawl member for enabling a sliding member to move forward and backward therein, the pawl member being connected to a fastener feed wheel whereby the apparatus can be operated easily with little effort being required by the user.

A further object of the present invention is to provide a tab attaching apparatus which can be readily assembled and repaired.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from the detailed description.

Briefly described, the present invention provides a tag attaching apparatus which comprises a pawl member operatively connected to a sliding member which is connected to a push rod for attaching a tag to wearing apparel and garments and a convertible lever connected to a connecting rod which is operatively connected to a fastener feed wheel through a pushing rod for rotating the fastener feed wheel in the counterclockwise direction when the sliding member moves backward whereby the apparatus operates easily, with little effort being required by the user.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
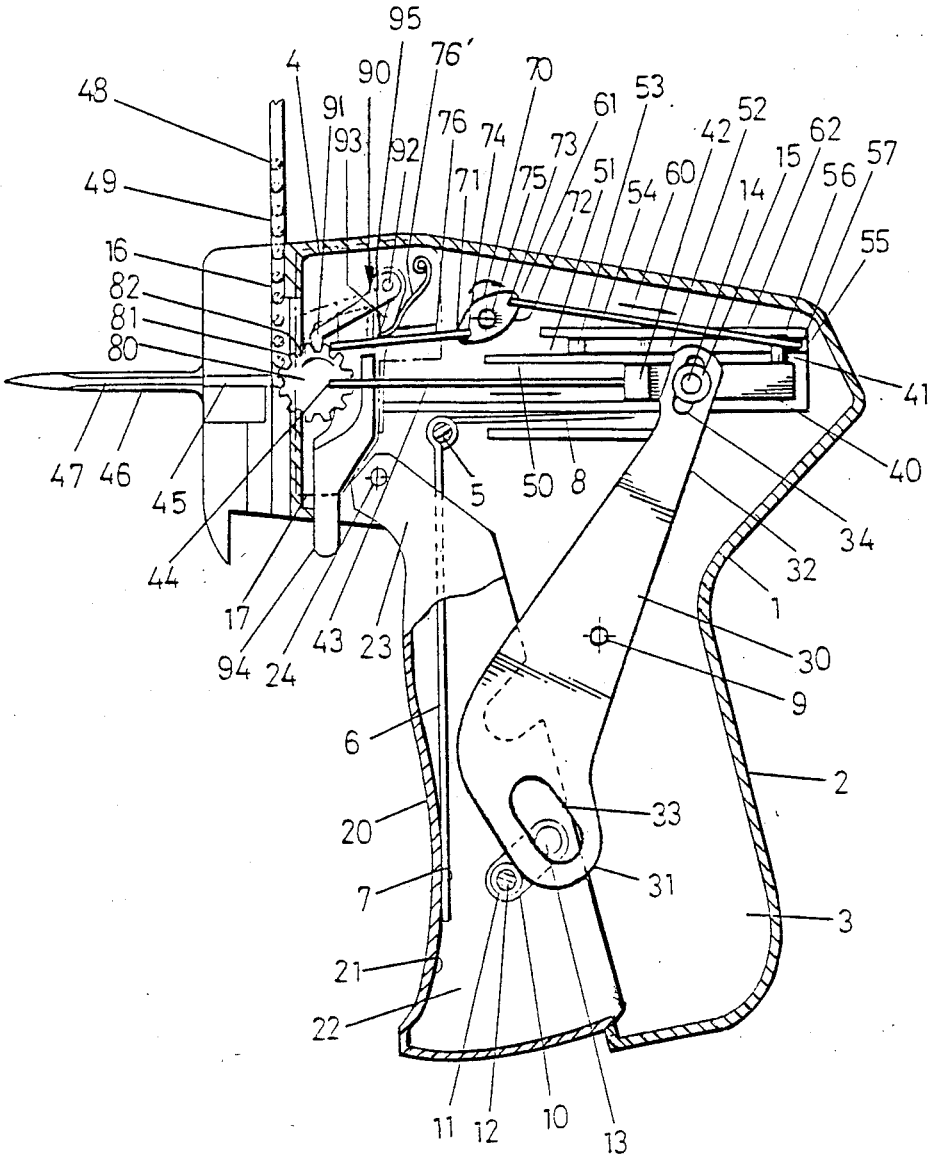
FIG. 1 is a side elevational view of an apparatus of the present invention with one of the body sections removed for showing operative components in their initial positions.
Figure 2:
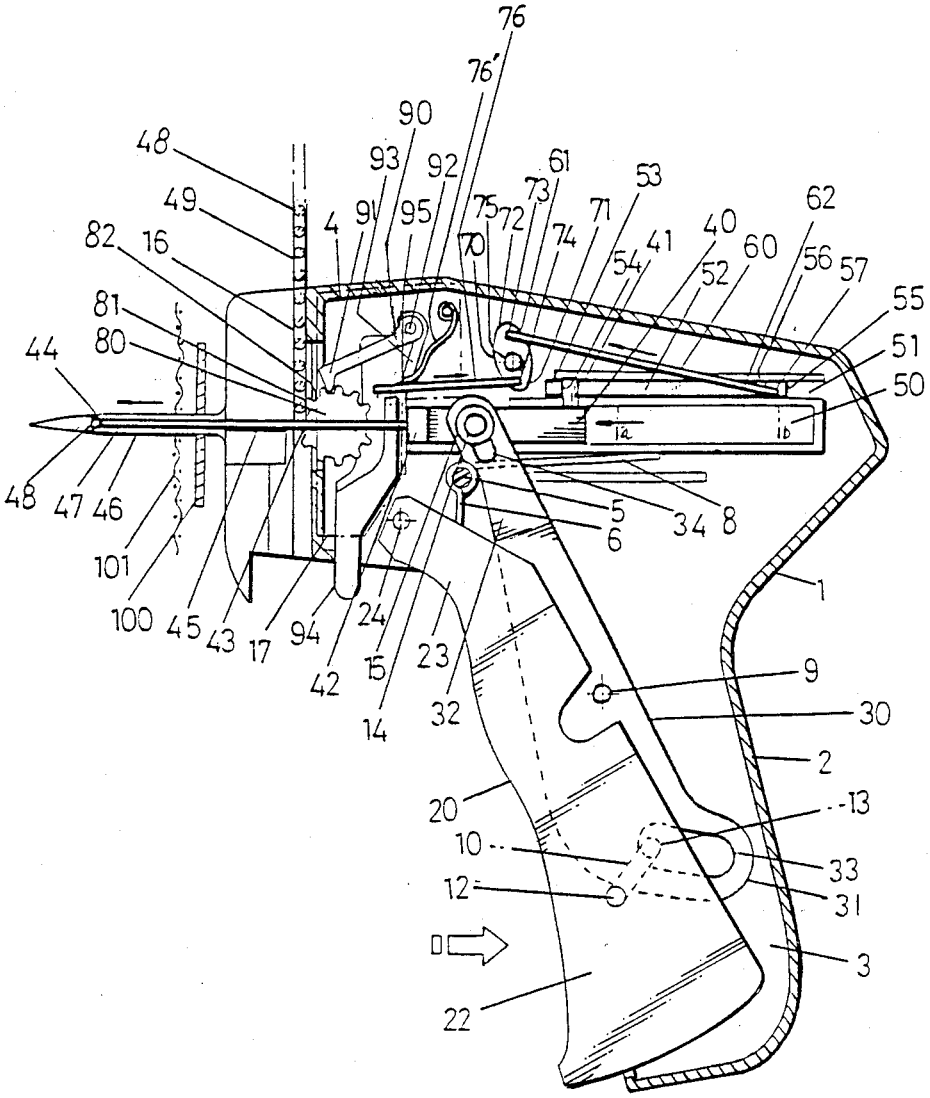
FIG. 2 is a side elevational view of the apparatus of the present invention with one of the body sections removed, showing operative components of the apparatus in their operating positions from the initial positions of FIG. 1.

Referring now in detail to the drawings for the purpose of illustrating the present invention, the tag attaching apparatus as shown in FIGS. 1 and 2 comprises a T-shaped body member 1 including an operating lever 20 disposed in a lower front side plate 22, a drive lever 30 disposed between the operating lever 20 and a lower rear side plate 3 of a handle portion 2, and a needle 46 attached to an upper front side plate 4 thereof.

The operating lever 20 is connected to the body member 1 through a pivot pin 24 disposed at an upper end portion 23 of the operating lever 20. The operating lever 20 is provided with a L-shaped bias spring 6 having a lower end 7 biased against an interior surface 21 of the operating lever 20, and an upper end 8 of the L-shaped bias spring 6 biased against the under surface of a first guiding member 50. The center of the L-shaped spring 6 is provided with a pivot pin 5 for biasing the operating lever 20 away from the handle portion 2 of the body member 1. Also, the operating lever 20 includes an engaging plate 10 having a pair of pins 12 and 13. The pin 12 has a rotating washer 11. One lower lever end portion 31 of the drive lever 30 is provided with an enlongated hole 33 for receiving the pin 13.

The drive lever 30 is pivotally attached to the body member 1 through a pivot pin 9 and provided with an elongated hole 34 disposed at the other upper lever end portion 32 thereof for receiving a pivot pin 14 with a washer 15. The pivot pin 14 is attached to a sliding member 40. The sliding member 40 is slidably disposed in the first guiding member 50 and is slidably displaceable in the backward and forward direction therein.

Figure 3:
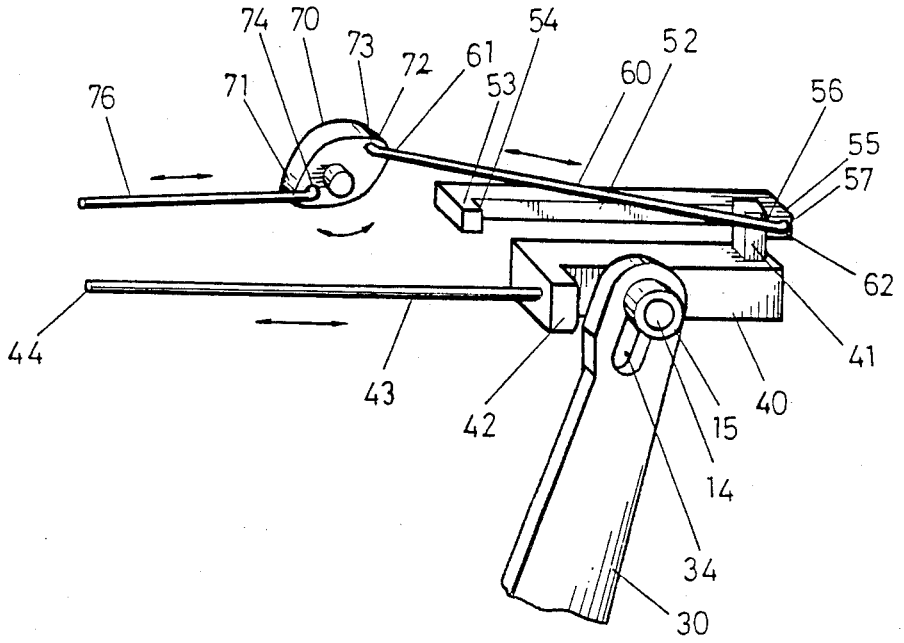
FIG. 3 is a perspective view showing the operative relationship of a pawl member, a sliding member and a convertible lever of the present invention.

As shown in FIG. 3, the sliding member 40 having a L-shaped configuration is provided with a fixed pin 41 disposed at one end thereof for engaging in the pawl member 52 and a push fastener pushing rod 43 having an end portion 44 which extends from the other end portion 42 thereof for pushing a fastener 48 into a needle conduit 45 and a needle slot 47 in the needle 46 (FIG. 1). The pawl member 52 engaged in a second guiding member 51 has a U-shaped configuration wherein front and rear end posts 53 and 55 are provided with inner surfaces 54 and 56 for operatively moving the fixed pin 41 between both inner surfaces. The rear end post 55 contains a post hole 57 for pivotally engaging one end 62 of a rod 60 which is connected, at the other end 61, to a convertible lever 70 through a rear hole 73 disposed at a rear portion 72 of the convertible lever 70. The convertible lever 70 which is mounted on a pivot pin 75 includes a front hole 74 disposed at a front portion 71 thereof for pivotally engaging a gear pushing rod 76. The gear pushing rod 76 is biased by a spring 76' of which one end portion 95 is attached to the gear pushing rod 76 and is attached to a leg 93 of a biased V-shaped stopper 90 (FIGS. 1 and 2).

As shown in FIGS. 1 and 2, a fastener feed gear wheel 80 sequentially receives the fasteners 48 of a fastener assembly 49 in a grooves 16 thereof. Also, a gear slot 82 of the fastener feed gear wheel 80 are operatively disposed to receive a holding member 91 of the biased V-shaped stopper 90. The end of the gear pushing rod 76 is pushed the teeth 81 of the gear wheel 80. To separate the holding member 91 of the stopper 90 from the gear wheel 80, a pushing plate 94 in a casing 17 is pushed through the upper end edge of the operating lever 20 and the one end portion 95 of the spring 76' pushes the leg 93 of the stopper 90 so as to pivotally rotate the stopper 90 about a pivot pin 92.

In operation, as shown in FIG. 2, by squeezing the handle portion 2 and the operating lever 20, the needle 46 inserts the fastener 48 into a desired garment 100 by passing it through a tag 101. The pushing plate 94 is then released from the leg 93 of the stopper 90 for engaging the tooth 81 with the gear slot 82 of the fastener feed gear wheel 80. At this time, by moving the sliding member 40 forward, the end portion 44 of the fastener pushing rod 43 delivers the fastener 48 behind the garment through the needle conduit 45 and the needle slot 47. Also, the gear pushing rod 76 separates from the gear wheel 80 since the pawl member 52 is moved forward by the movement of the sliding member 40 in the forward direction until the rear inner surface 56 moves to a line "b" by pulling the gear pushing rod 76 (FIG. 2). When the operating lever 20 is released from the handle portion 2, the stopper 90 releases from the gear wheel 80 and simultaneously, the gear pushing rod 76 pushes the tooth 81 of the gear wheel 80 so that the gear wheel 80 rotates in the counterclockwise direction and the fastener 48 is engaged into the gear slot 82 thereof. The fastener 48 disposed in the gear slot 82 mates with an inlet of the needle conduit 45. At this time, the fastener pushing rod 43 returns to its original position since the operating lever 20 is returned due to the biasing power of the bias spring 6.

Accordingly, during operation of the apparatus, the sliding member 40 and the pawl member 52 move forward and backward along the first and second guiding members 50 and 51 so that the apparatus is operated with little effort being required by the user.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is

1. An apparatus for attaching a tag to a surface of a garment using fasteners, said fasteners being arranged in an assembly and being coupled to a common carrier member by respective coupling members, said apparatus comprising:

a body member having a hand portion, a needle supported on one side of said body member, a operating lever pivotally attached to said body member and provided with a spring member which is biased against the hand portion of said body member, said spring member having a substantially L-shaped configuration, a drive lever pivotally connected at one end thereof to said operating lever, a sliding member having a substantially L-shaped configuration, disposed in said body member, the other end of said drive lever being pivotably connected to said sliding member, said L-shaped sliding member having a fixed pin at the one end and a fastener pushing rod at the other end thereof, a pawl member having a substantially U-shape for receiving said fixed pin, said pawl member being provided with a pivotal rod which is pivotally connected to a convertible member including a pivotal gear pushing rod, wherein when said fixed pin is moved in a forward and backward direction within said pawl member, said gear pushing rod moves in a backward direction and a forward direction, and a stopper having a substantially V-shaped configuration about a pivot pin, said V-shaped stopper being fixed to said gear pushing rod with a bias spring at one end and being able to operatively engage with teeth of a fastener feed gear wheel at the other end thereof for locking said gear wheel between the operation of a pushing plate which is operatively contacted to an upper end edge of said operating lever and said gear pushing rod, whereby, upon the squeezing of said operating lever against said hand portion of the body member, said tag is readily and easily attached to said surface of the garments by said fasteners with little effort being required by the user.

2. The apparatus of claim 8, wherein the drive lever includes an upper elongated hole for pivotally receiving a pivot pin disposed on said sliding member, said drive lever further including a lower elongated hole for pivotably receiving one of a pair of pins disposed on said operating lever.

* * * * *